US012092418B2

(12) United States Patent
Hughes et al.

(10) Patent No.: US 12,092,418 B2
(45) Date of Patent: Sep. 17, 2024

(54) INTEGRATED PISTOL AND RIFLE TRAINING METHOD AND APPARATUS

(71) Applicant: NextLevel Training LLC, Ferndale, WA (US)

(72) Inventors: Michael Frank Hughes, Maple Falls, WA (US); Thomas Ryan Swetish, Bellingham, WA (US); Britton R Lentz, Everson, WA (US)

( * ) Notice: Subject to any disclaimer, the term of this patent is extended or adjusted under 35 U.S.C. 154(b) by 750 days.

(21) Appl. No.: 17/203,877

(22) Filed: Mar. 17, 2021

(65) Prior Publication Data

US 2022/0074699 A1 Mar. 10, 2022

Related U.S. Application Data

(60) Provisional application No. 62/963,203, filed on Jan. 20, 2020.

(51) Int. Cl.
*F41A 33/02* (2006.01)

(52) U.S. Cl.
CPC ..... *F41A 33/02* (2013.01)

(58) Field of Classification Search
CPC ..... F41A 33/02
See application file for complete search history.

(56) References Cited

U.S. PATENT DOCUMENTS

2003/0195046 A1* 10/2003 Bartsch ..... F41A 33/02 463/36
2020/0240743 A1* 7/2020 Cahill ..... F41C 23/14

OTHER PUBLICATIONS https://www.thetruthaboutguns.com/gear-review-caa-micro-conversion-kit-mck/ (Year: 2019).*

* cited by examiner

*Primary Examiner* — Jeffrey S Vanderveen
(74) *Attorney, Agent, or Firm* — Michael Frank Hughes

(57) ABSTRACT

A rifle pistol training assembly comprises an inert training pistol and a rifle chassis. The inert training pistol in one form is a widely commercially available sirt training pistol. The SIRT training pistol has an auto resetting trigger and emits a shot indicating laser when a trigger is pressed. And further, in a preferred form, this SIRT pistol has a second laser generally referred to as a trigger take-up laser which is activated prior from a full break of a trigger for various training and safety needs. Further, the inert training pistol can be a variety of forms of inert pistols of non-configurative fire and live round.

18 Claims, 20 Drawing Sheets

INTEGRATED PISTOL AND RIFLE TRAINING METHOD AND APPARATUS

TECHNICAL FIELD OF THE DISCLOSURE

The present disclosure relates to an arm training device, and, more particularly, an integrated pistol and rifle training method and apparatus.

BACKGROUND OF THE DISCLOSURE

Training for firearms is an important endeavor for anyone in a civil society. Whether a citizen enjoys firearms or is repulsed by them, basic training of how a firearm is utilized with regard to the fundamental rules of trigger finger discipline and awareness of the muzzle are critical skills to prevent an accident.

However, many logistical challenges are faced when training with firearms, that is live firearms, such as acceptance of end users of a live firearm introduced into their training area, the attitude, and culture of certain training venues such as universities to logistically allow live firearms that are capable of emitting a projectile under their premise, further, institutions such as police academies or military institutions have extended protocols around live firearms to be in compliance with, for example, the Alcohol, Tobacco, and Firearm Agency for maintenance and accountability if any of the live firearms are lost or stolen or otherwise gone missing. When conducting large classes, it can be incredibly difficult to keep track of all the equipment. Although loss of a training device has its disadvantages, it is not nearly the same magnitude of issue as a loss of a firearm requiring extensive regulatory compliance and paperwork.

Training with end firearms can be generally split into pistol training or rifle training. Pistols have adopted a strong foothold in the marketplace for their concealability and convenience of carry. However, a dominant tool within firearms community is a rifle. Rifles tend to be more forgiving and easier to shoot and master. Rifle training has additional skill sets such as utilizing a sling, adjusting the buttstock, managing offset from an optic to the line of sight of the muzzle. Further skills require sling manipulation and, of course, working a selector switch on platforms such as an AR-15-style platform. Many of these skills are often not trained sufficiently to people who own rifles; in particular, the very basic skill of understanding "offset" and manipulating the selector switch (safety). There's inherently a distance from any kind of optic or sight on the top of the rifle and the injection path of a bullet (the line of the muzzle). Now these lines ultimately overlap and coincide at some sighted and distance; say for example, 100 yards. But, at a much shorter distance, (say to the tune of 10 to 30 feet) in front of a barrel, there is a very clear offset between what the optic is showing the bullet impact as and what the actual bullet impact will be. For law enforcement training, this knowledge of offset is incredibly important because in a close critical shot such as a hostage situation, if the officer puts "the dot" of the optic right on the target, he or she can expect the bullet to be about 1½ to 2 inches below that dot depending on the distance to the target. This can, of course, have catastrophic results in a very tight close shot.

For further skill it must be trained in extremely high volume is simply working the selector switch otherwise known as the safety switch. In a common AR-15-style platform when the gun comes up, the safety must be placed in a downward substantially vertically lined orientation so the gun can be operated. When the gun muzzle comes down, the safety must come up in standard operating procedures, so the safety is on. Most all common modern rifle disciplines, use of the safety is very, very important.

Further, a rifle requires a lot of manipulation skills particularly with the sling. Various maneuvers with the sling such as going from a low ready to high ready to fully extending the rifle, dropping the rifle and relying on the sling to hold it to the shooter's body, positioning the rifle behind one's back for climbing and other activities, utilizing the sling at a prone position for better stability and accuracy, and basically just getting in and out of the rifle sling quickly and easily with fluid motion.

Of course, there's a plethora of training needs for anyone who possesses or may need to use a firearm, whether it be a pistol or a rifle. The disclosure below shows a novel and useful way to repurpose an inert training pistol such as that as U.S. Pat. No. 8,646,201 which is an issued patent by the applicant and is incorporated by reference.

Having the cost-effective assembly of a pistol-rifle combination is extraordinarily beneficial for an end user or an instructor to fluidly allow rifle and pistol training in a single class. By having a chassis system operably configured to SIRT or other inert tool knotted therein is extraordinarily advantageous to repurpose all the intimate details and technology of a laser emitting device with a robust auto resetting trigger into a rifle chassis. The rifle chassis can be produced and sold relatively economically whereby a lot of the technological heavy lifting is done by the pistol.

Further disclosed embodiments herein are fairly novel methods of carrying out particular aspects of the disclosure such as a very novel and ingenious method of providing a retro fitting and fully functional safety system to have, in one form, laterally slanted surface engage a biasing surface of a safety selector. This laterally slanted surface will bias a lateral extension in and out to interposed and non-interposed position of the trigger and the frame of the pistol. It basically allows for a mechanical system to functionally work as a safety to be easily retro fitted with the inter training pistol. The rifle chassis is particularly useful for people and for instructors and shooters who already own an inert training pistol and choose to extent their training into the realm of rifle-craft.

In a preferred form, the rifle pistol training assembly is operably configured to emulate many of the features of a live fire system such as an AR-15, but of course, can be operably configured to emulate other rifles such as, but not limited to, an AK 47, an FAL, a mini-14, of course the AR 10, and many other rifle systems. Further, the inert training pistol as shown herein is shown as commercially available, highly successful firearm known as the SIRT 110 which as functional features of a Glock 17/22 and another variance. However, of course, the inert training pistol can be of various forms or even a generic form such as the SIRT pocket pistol which has a harmonist design emulating many of the smaller pistols. Further, the inert training pistol can be adopting the functional features of say the SIRT PT20 such as the SIRT 20 or a SIRT 2017 having functional features of a Smith and Wesson and M&P.

But the final formats of the tools are often preferential to end users, but all share very much the same traits and in particularly the training tool, the most important elements are, of course, trigger finger discipline that is keeping the finger off the trigger until ready to shoot and, of course, muzzle awareness where the firearms (inert firearms in this case) are not pointed at anything the shooter wishes to destroy.

SUMMARY OF THE DISCLOSURE

In view of the foregoing disadvantages inherent in the prior art, the general purpose of the present disclosure is to provide an integrated pistol and rifle training method and apparatus, to include all advantages of the prior art, and to overcome the drawbacks inherent in the prior art.

An object of the present disclosure is to provide a cost-effective assembly of a pistol-rifle combination for an end user or an instructor to allow rifle and pistol training in a single class.

An object of the present disclosure is to provide a cost-effective assembly of a pistol-rifle combination having a chassis system operably configured to SIRT or other inert tool knotted therein to repurpose all the intimate details and technology of a laser emitting device with a robust auto resetting trigger into a rifle chassis.

Another object of the present disclosure is to provide a cost-effective assembly of a pistol-rifle combination including a rifle chassis that can be produced and sold relatively economically whereby a lot of the technological heavy lifting is done by the pistol.

In light of the above objects a rifle pistol training assembly operatively configured to allow a user to train with either a rifle or a pistol with inert firearm training tools is provided. The assembly includes a rifle chassis, a pistol mount region, an inert training pistol. The rifle chassis includes a forward end, a central portion, and a butt stock region. The pistol mount region is generally located at the central portion of the rifle chassis. The inert training pistol configured to have a trigger movably mounted thereto wherein said trigger is configured to have a forward position and a rearward position being configured to be repositioned from a forward position to a rearward position by the user. The rifle pistol training assembly is being operatively configured to allow the user to train with the inert training pistol or mount the inert training pistol to the pistol mount region of the rifle chassis, whereby providing for rifle training, and whereby the trigger of the inert training pistol now emulates a trigger for a rifle for training therewith by the user.

In one embodiment, the buttstock region, in the rifle pistol training assembly as recited above, is provided with a butt stock. The butt stock may be movable along a longitudinal axis to various positions, therein, the butt stock region of the rifle chassis. The butt stock may be like a AR15-style butt stock.

In one embodiment, the butt stock region has a non-circular dimension, whereby not provided for a spring or other biasing device to be mounted therein.

In one embodiment, the inert training pistol is provided with a picatinny rail in a longitudinally forward region of the inert training pistol, and said picatinny rail is operatively configured to mount to a picatinny rail receiving surface of the pistol mount region of the rifle chassis.

In one embodiment, the pistol mount region comprises a mount member that is pivotally attached to a rifle base and wherein, at a longitudinally rearward location to a pivot attachment location, a rearward lock member is provided having a lock extension that defines a lock surface, which is operatively configured to engage a locking surface of the rifle base.

In one embodiment, a selector switch is provided, wherein a safety selector is pivotally mounted to the rifle chassis, and wherein the safety selector is operatively configured to bias a safety bar having a lateral extension that is configured to be interposed between the trigger of the inert training pistol and a frame of the inert training pistol.

In one embodiment, the safety bar is connected to a pivot base where said safety selector is provided with a biasing surface, and said biasing surface of safety selector is operatively configured to reposition the pivot base laterally outward, wherein the lateral extension moves from a safety-on position where the lateral extension is interposed between the trigger and the frame and the safety selector is configured to position the biasing surface wherein a portion of the pivot base moves laterally outward, so the lateral extension of the safety bar is not interposed between the trigger and the frame of the inert training pistol, wherein allowing the trigger to freely travel from the forward position to the rearward position.

In one embodiment, the pivot base is pivotally connected to the rifle chassis and further has a laterally inward-extending member that is configured to engage a top portion of the inert training pistol so as when the inert training pistol is mounted to the rifle chassis, the laterally inward-extending member repositions vertically upwardly, wherein biasing the lateral extension of the safety bar laterally inwardly.

In one embodiment, the safety selector having the biasing surface is operatively configured to engage a laterally-slanted surface of the safety bar, wherein when the safety selector has a thumb engagement portion extended substantially in a longitudinal direction, the biasing surface of the safety selector is engaging a laterally outward portion of the laterally-slanted surface, wherein allowing the lateral extension to extend laterally inward to be interposed between the trigger and the frame of the inert training pistol, wherein when the safety selector thumb engagement potion is repositioned in a substantially vertical orientation, the biasing surface is now engaging a laterally inward portion of the laterally-slanted surface, which wherein biases the lateral extension of the safety bar laterally outward so as not to be interposed between the trigger and the frame, allowing free motion of the trigger and the frame from the set forward to rearward positions.

In one embodiment, the mount member has a surface defining a mag-receiving cavity to allow a magazine to be mounted therein.

In one embodiment, the surface defining a mag-receiving cavity is operatively configured to receive a AR15 magazine, wherein the rifle chassis has a picatinny rail mounted in the upper portion.

In one embodiment, the butt stock region has a sling mount fixedly attached thereto.

In one embodiment, the sling mount is a metallic component over-molded within a plastic injection butt stock region.

In one embodiment, the rifle chassis is comprised of first and second frame members, wherein a mock barrel is interposed to the first and second frame members.

In one embodiment, the mock barrel is comprised of stainless streel and could be repositioned in the longitudinal direction.

In one embodiment, the rifle chassis comprises a forward grip region having a picatinny rail and surfaces defining mounting points.

In one embodiment, the inert training pistol is configured to mount within the picatinny rail receiving service and rotate upward, wherein the rearward lock member is operatively configured to house a rearward upper tang portion of the inert training pistol and a lock extension, having a locking surface, snaps to a locking surface of the rifle chassis.

In one embodiment, the lock extension has a disengagement surface, wherein end user pressing the disengagement surface will release interaction between the locking surface of the lock extension and the locking surface of the rifle chassis, wherein allowing the rearward lock member to reposition substantially downwardly with the inert training pistol, so thereby, the inert training pistol can be removed and separated from the rifle chassis.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF DRAWINGS

The advantages and features of the present disclosure will become better understood with reference to the following detailed description taken in conjunction with the accompanying drawing, in which.

Like reference numerals refer to like parts throughout the description of several views of the drawing.

DETAILED DESCRIPTION OF THE EMBODIMENTS

The exemplary embodiments described herein detail for illustrative purposes are subject to many variations in implementation. The present disclosure provides integrated pistol and rifle training method and apparatus. It should be emphasized, however, that the present disclosure is not limited only to what is disclosed and extends to cover various alternation to the wall-climbing toy vehicle. It is understood that various omissions and substitutions of equivalents are contemplated as circumstances may suggest or render expedient, but these are intended to cover the application or implementation without departing from the spirit or scope of the present disclosure.

The terms “a” and “an” herein do not denote a limitation of quantity, but rather denote the presence of at least one of the referenced items.

The terms “having”, “comprising”, “including”, and variations thereof signify the presence of a component.

Figure 1:
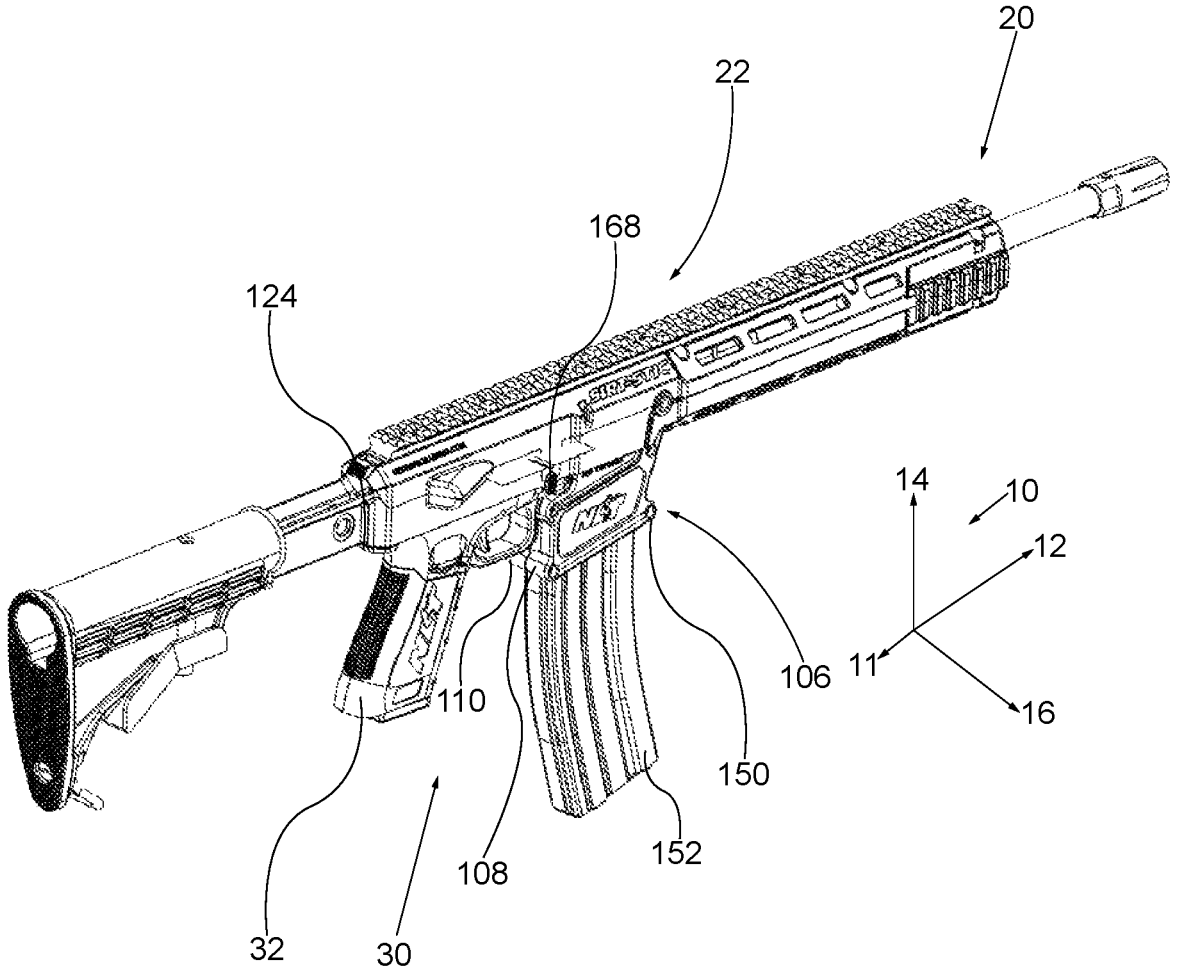
FIG. 1 shows a laterally left downward isometric view of the rifle pistol training assembly, in accordance with an exemplary embodiment of the present disclosure.
Figure 5:
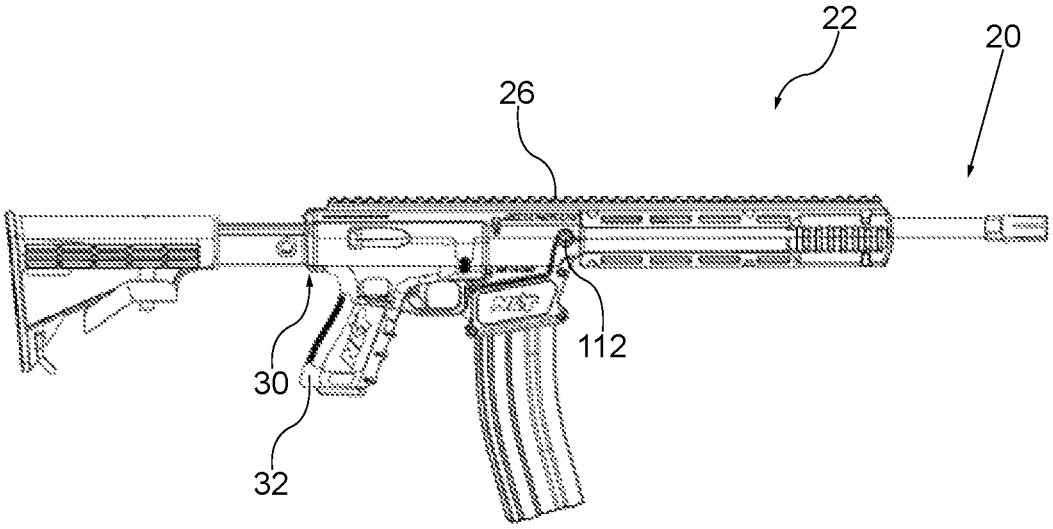
FIG. 5 shows a lateral or diagonal view of the rifle pistol training assembly and its two main parts; that is the rifle chassis and inert training pistol, in accordance with an exemplary embodiment of the present disclosure.

Disclosed herein is a rifle pistol training assembly shown in one form as a main embodiment whereas it can be appreciated that many other forms of the claimed invention can be manufactured, sold, and produced without departing from the spirit and scope of the claims. As shown in FIG. 1, there is a rifle pistol training assembly 20. The rifle pistol training assembly 20 as shown in FIG. 5 if generally comprised of an inert training pistol 32 and a rifle chassis 22. The inert training pistol 32 in one form is a widely commercially available SIRT training pistol which is fully described in one firm in U.S., 846, 201 which as noted above is incorporated by reference. But, the SIRT training pistol has an auto resetting trigger and emits a shot indicating laser when a trigger is pressed. And further, in a preferred form, this SIRT pistol has a second laser generally referred to as a trigger take-up laser which is activated prior from a full break of a trigger for various training and safety needs. But the inert training pistol 32 can be a variety of forms of inert pistols of non-configurative fire and live round.

Before further detailed description of the inert training pistol 32, there will now be a discussion of the rifle chassis 22. In general, it is useful to have an axis system to help and aid the description of the preferred embodiment. Although not intended to be strictly limited by an axis system 10, the general directions are useful for describing the orientations in a preferred form.

As shown in FIG. 1, the axis system 10 generally is comprised of a longitudinal axis 12 where the arrow of vector 12 axis is pointed in a forward direction otherwise referred to a longitudinally forward direction whereby the opposed general region is the longitudinally rearward region. The axis 14 is noted as a vertical axis or vector. And again, the arrow indicates an upward direction. Of course, it can be appreciated that their rifle pistol training assembly can be orientated in a variety of positions if not upside down in certain Ozzy repel inverted type usage. But nonetheless, the general orientation of the rifle pistol training assembly has the vertical axis 14 substantially vertical at least for the purpose of this description and discussion.

Figure 10:
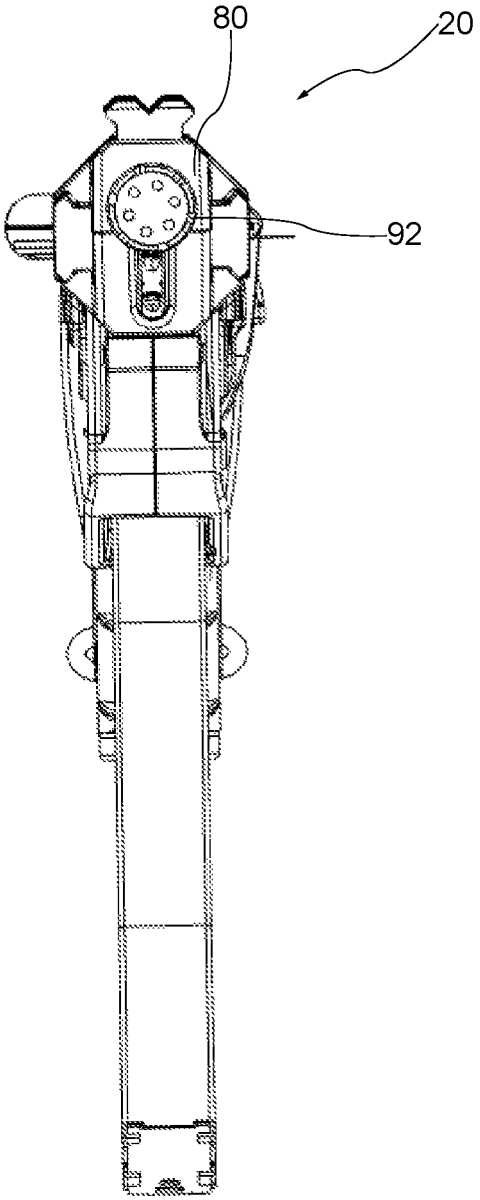
FIG. 10 shows a front view of the rifle pistol training assembly whereby it should be noted a front cap is provided on the mock barrel which in most common form will be plastic injection and colored so as to clearly note it is a live fire tool, in accordance with an exemplary embodiment of the present disclosure.
Figure 11:
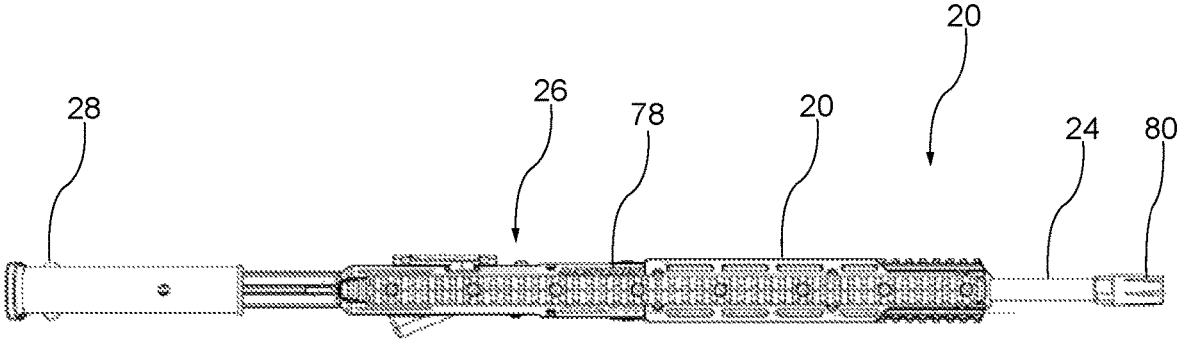
FIG. 11 is a top or diagonal view of the rifle pistol training assembly, in accordance with an exemplary embodiment of the present disclosure.
Figure 12:
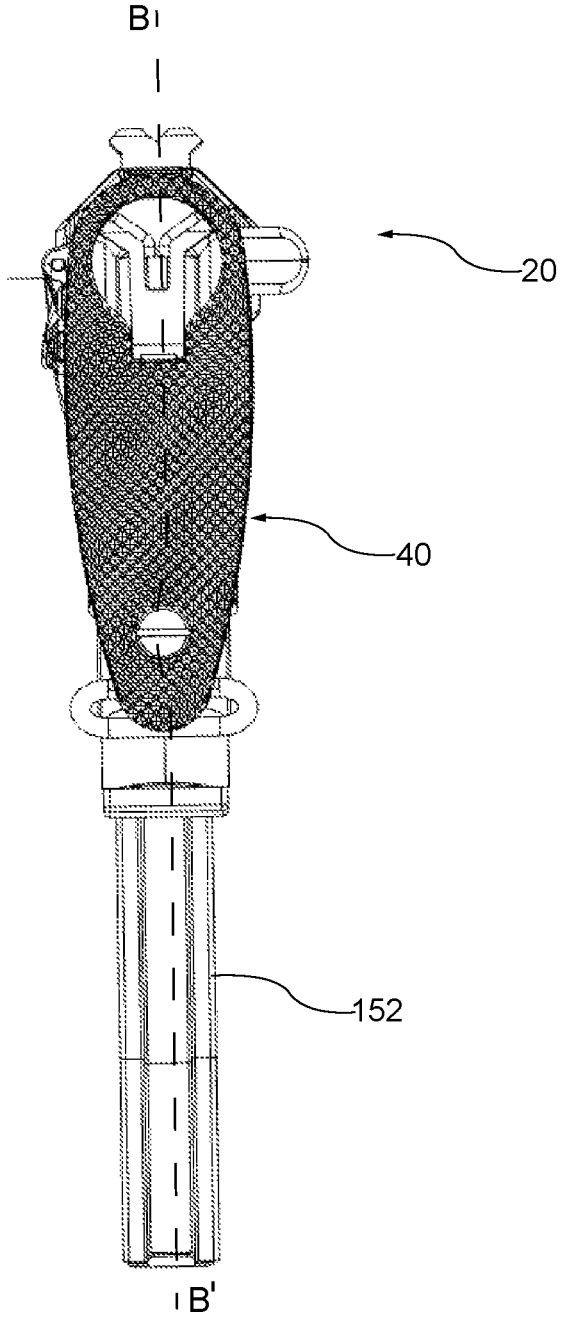
FIG. 12 is a rearview of the rifle pistol training assembly with, of course, the optional buttstock mounted thereto the assembly, in accordance with an exemplary embodiment of the present disclosure.

The axis 16 indicates a lateral axis or lateral vector where the arrow of axis, lateral axis 16 indicates a left direction and the opposing direction generally denotes a right direction. Where, of course, the terms left and right are generally used to describe certain orientations and relationships between components in a preferred form. It should further be noted that a laterally outward direction generally is noted from a center line of the rifle pistol training assembly and then laterally outward therefrom. For example, as shown in FIG. 10, note the axis system 10 whereby the vertical axis 14 is roughly in-lined with the lateral center of the rifle pistol training assembly 20. Whereby the axis 16 shows the lateral axis pointed in a laterally outward direction from the intersecting base generally noted at 11.

Figure 2:
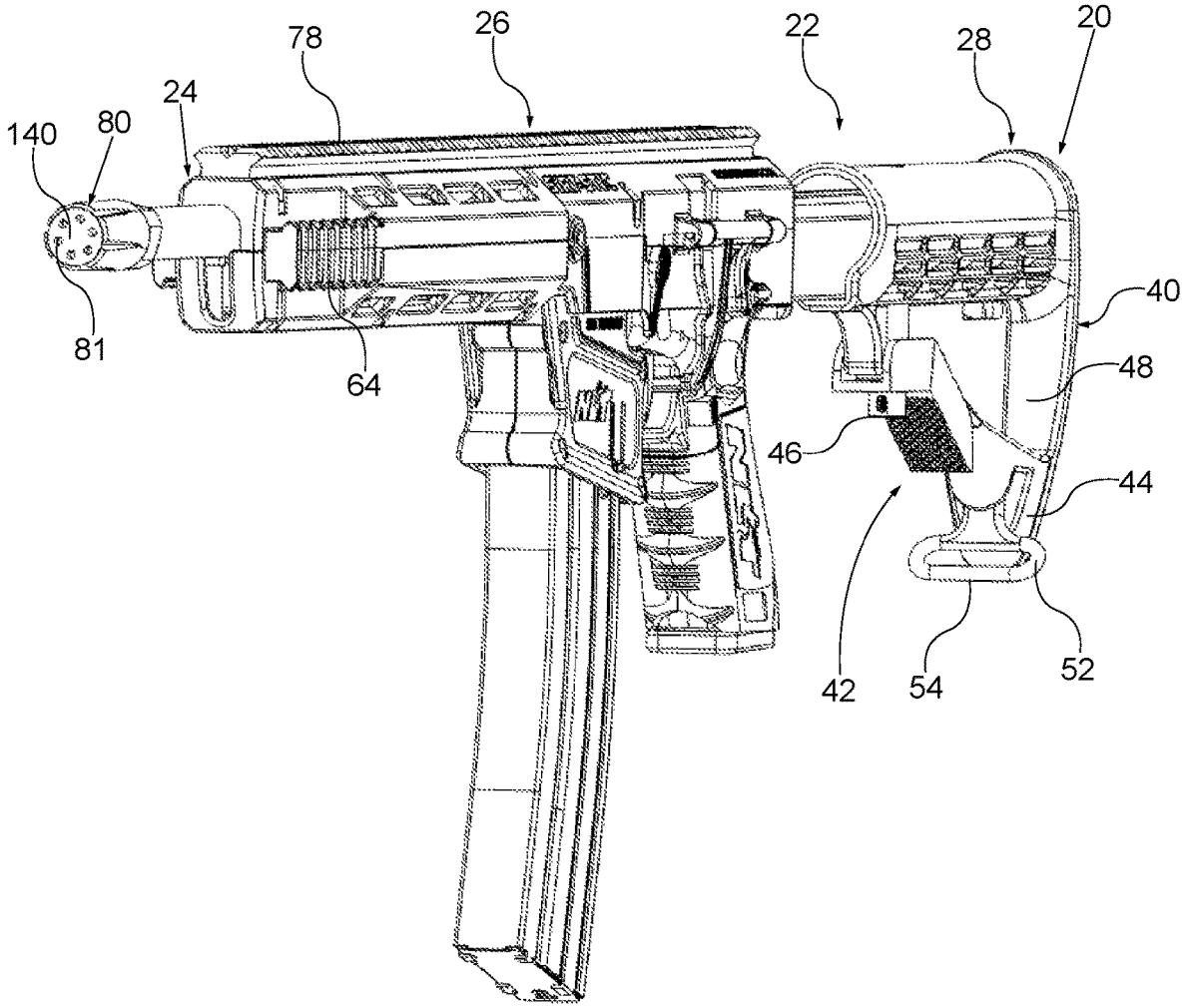
FIG. 2 shows the rifle pistol training assembly from a rear position but on the right lateral side, in accordance with an exemplary embodiment of the present disclosure.

With the foregoing of the axis description in place, let us now continue to a detailed description of the rifle chassis 22 referring now to FIG. 2. The rifle chassis 22 is generally comprised of a forward end 24, a central portion 26, and a buttstock region 28. Starting from the longitudinal rearward portion of the rifle chassis 22, the buttstock region 28 is operably configured to have a buttstock 40 mounted thereto. To any reader who is knowledgeable with firearms, as shown in the various drawings the buttstock 40 is that of a AR-15 buttstock which is widely known and used in the firearm arts. Normally a Buttstock 40 is configured to mount around a buffer tube of an AR-15 (or any of the AR-15 variance whereby AR-15 is generally noted for this style and model of firearm). In a live fire tool, the buffer tube has a spring or other biasing member contained therein to counteract the impulse from the bullet and carriage group traveling rearward from the expanding gases of a fired shell. The tube therefore must have an anterior hollow cavity to provide the spring (or other biasing members such as a piston system) and a plunger therein to move in the longitudinal direction. However, with the training platform no such functionality is required; therefore, the buttstock region 28 can be comprised of a cross section other than is hollow cylindered. In one form, a buttstock mount 42 is provided which can be a Y-shaped member. In this form, as shown in FIG. 1, the lower extension 44 is substantially vertical and the left and right upper wings 46 and 48 are provided having an extended surface to engage the inner surface of the buttstock 40. Not shown in the figures but conventional in the arts, the lower extension 44 has a plurality of cylindrical cavities therein, so the lock mechanism of the buttstock 40 having an internal pin conventional in the arts can engage therein to adjust the position of the buttstock there along the buttstock mount 42.

Figure 9:
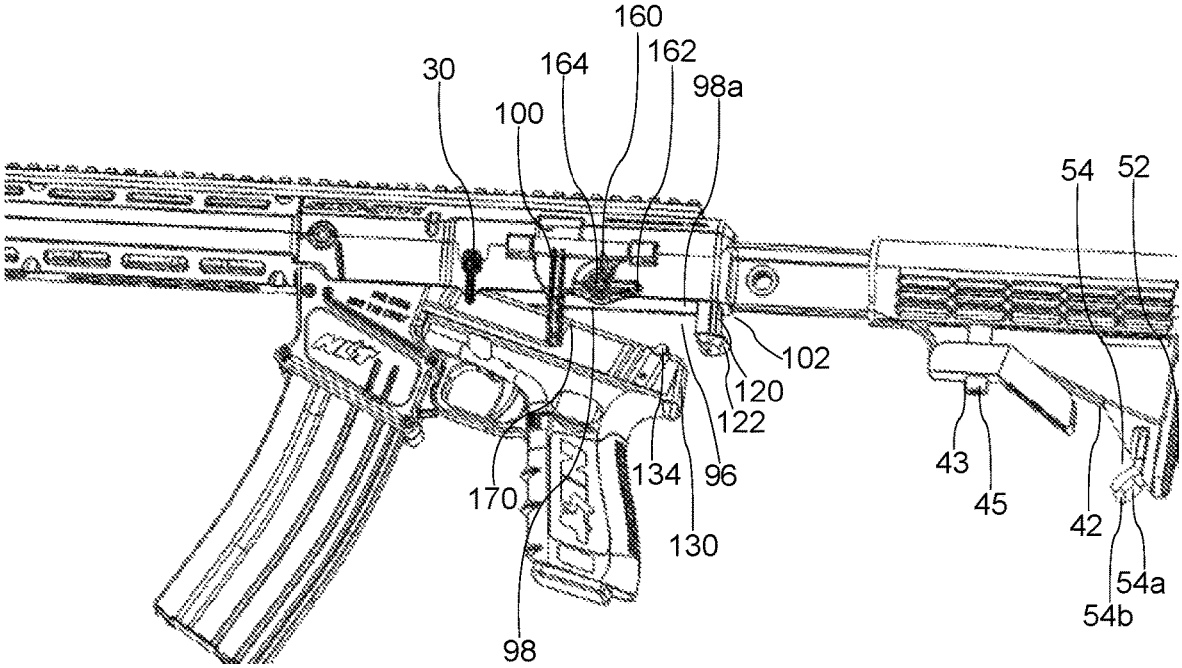
FIG. 9 shows another close-up view of the rearward lock member in its relative position in the assembly without the first or second frame members of the rifle chassis whereby showing the inner components of the rifle pistol training assembly, in accordance with an exemplary embodiment of the present disclosure.

It should further be noted that a sling mount 52 as shown in FIG. 2 and better shown in FIG. 9, is operably configured to have a swivel swing mount therein. In general, the shoulder 54 is provided whereby the inner cavity **54*a* is of a larger radius due to defining the shoulder 54 so a general sling mount 54*b* can mount therein. Such mounts are conventional in the arts, but in a preferred form, the sling mount 52 is rigidly therein attached to the buttstock mount 42 as shown in FIGS. 1 through 4** by way of over molding in a plastic injection molding process, but, of course, other forms of materials and construction methods can be utilized.

Figure 3:
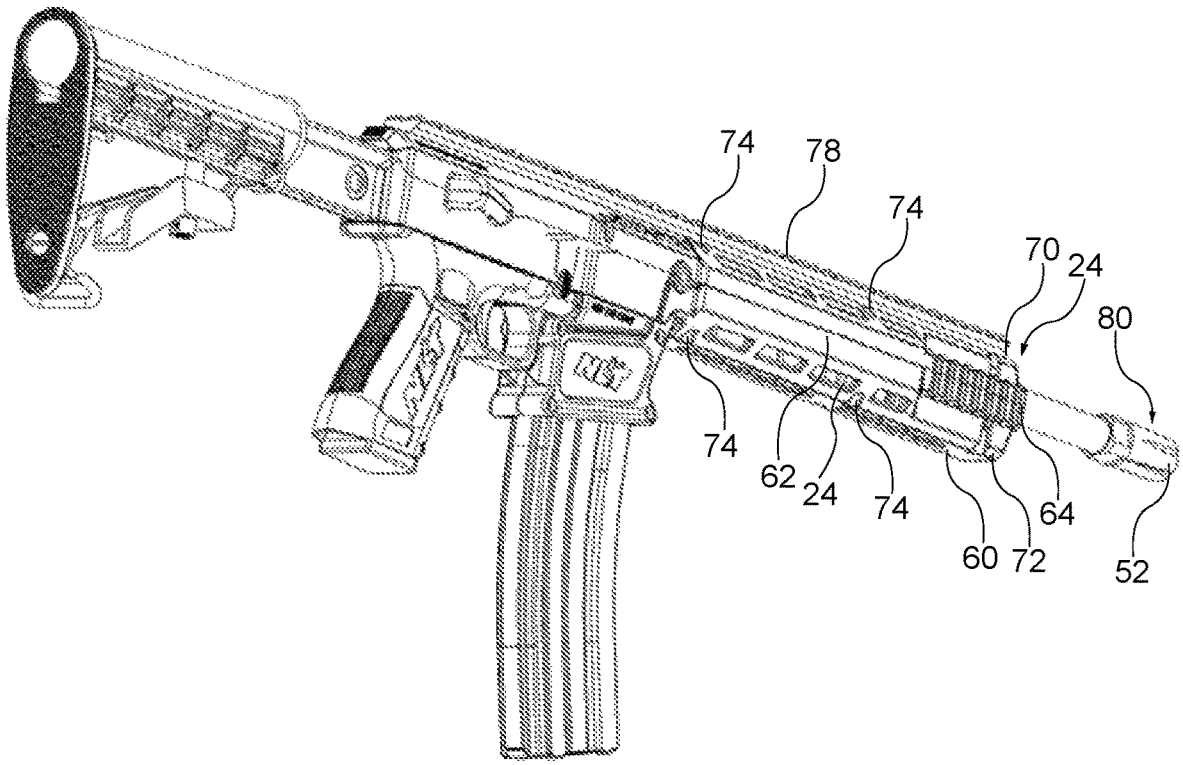
FIG. 3 shows an isometric view of the rifle firearm training assembly from a longitudinally forward and upward vantage point whereby showing the lateral left side of the assembly and noting the selector switch position on the laterally outward portion of the assembly, in accordance with an exemplary embodiment of the present disclosure.

With the foregoing description of the buttstock region 28, let us now discuss the other longitudinal end of the rifle focusing on the forward end 24 with reference now to FIG. 3. The forward end 24 generally comprises a forward stock 60. A buttstock changes forward stock in the claims to forward grip region. A forward grip region is very conventional with all rifles providing a fore grip of some form that is separate from the barrel (which can get hot) whereby the user's non-firing hand is configured to grasp this area. There is much debate in this course as to how and what a forward grip region is configured in as attached thereto. However, the purpose of this tool is training and allowing the end user to configure their rifle pistol training assembly as they would their live firearm kit. Alternatively, test out various attachments and configurations before committing to live fire. For example, many shooters put lights on their fore grips, back-up optics, sling mounts, pistol grips, bipods and tripods in some instances, etc. Therefore, the fore grip is not only of a sufficient diameter to be grasped, but an inner conventional manner similar to live fire guns there are surfaces 27 defining attachment points which, for example, can be key locks or mods or other types of attachment protocols conventional in the industry. Further, a lateral picatinny rail 64 is provided to directly attach any of the various picatinny mount systems thereto. In a preferred form, the lateral picatinny rail 64 is part of a first frame member 70. In one preferred form is a unitary structure that extends from the Forward End 24 all the way to the Buttstock Region 28. If the first frame member 70 is a unitary structure and one form of plastic injection aligned, the plastic injection, the first frame member 70 is fairly rigid and strong providing structural integrity to the Rifle Chassis 22. In one form, the first frame member 70 is attached to a second frame member 72 which in one form is essentially pleasingly matched to the first frame member 70 to form the Forward Grip Region 60. It should be noted that the Lateral Picatinny Rail 64 in a preferred form is either part of the first frame member 70 or the second frame member 72. In other words, instead of having a split line along this picatinny rail, it is desirable to have the picatinny rail and unitary complete structure on either frame member. In the preferred embodiment, the lateral picatinny rail 64 is integral and a part of the first frame member 70 and the second frame member 72 attaches thereunder.

In general, the first frame member 70 and second frame member 72 are attached to one another by conventional fastening methods such as by conventional nut and bolt assemblies whereby generally shown at the locations 74. A small notable detail is the lower second frame member 72 at the general location point 74 can be of an accidental shape whereby to fit a nut therein and allow the nut to lock so a screw in the upper portion can easily be turned thereto without the nut rotating. This, of course, uses assembly as shown in FIGS. 1 through 4, an upper picatinny rail 78 is provided which in one form is a separate piece that bolts thereto the first frame member 70. Of course, the upper picatinny rail 78 is an optional component but provides a fantastic conventional set up for various mounts to be attached thereto such as optics, iron sights, etc. Of course, this upper picatinny rail 78 could be integral and formed with the first frame member 70 in for example a plastic injection process of machined, casted or the like. But in a preferred form, it is a separate member fixably mounted thereto the first frame member 70. More specifically, preferred form of manufacture is having an upper picatinny rail 78 that is extruded aluminum with possible post-machine steps but having surfaces defining cavities for bolts to pass there through to mount to holes therein of the first frame member 70. This allows for a very rigid like member to straighten out any deficiencies of a plastic injected part such as warpage, etc. Further, a metal upper picatinny rail 78 has a desirable feel to the end user and, of course, is structurally robust to have attachments mounted thereto. As a final detailed note, the picatinny rail, of course, has various overhangs and having a separate piece 78 attached to the P70 allows for a less expensive plastic injection mold for the first frame member 70 for substantially vertically aligned A and B halves to open and shut without expensive slides or the like.

Figure 13:
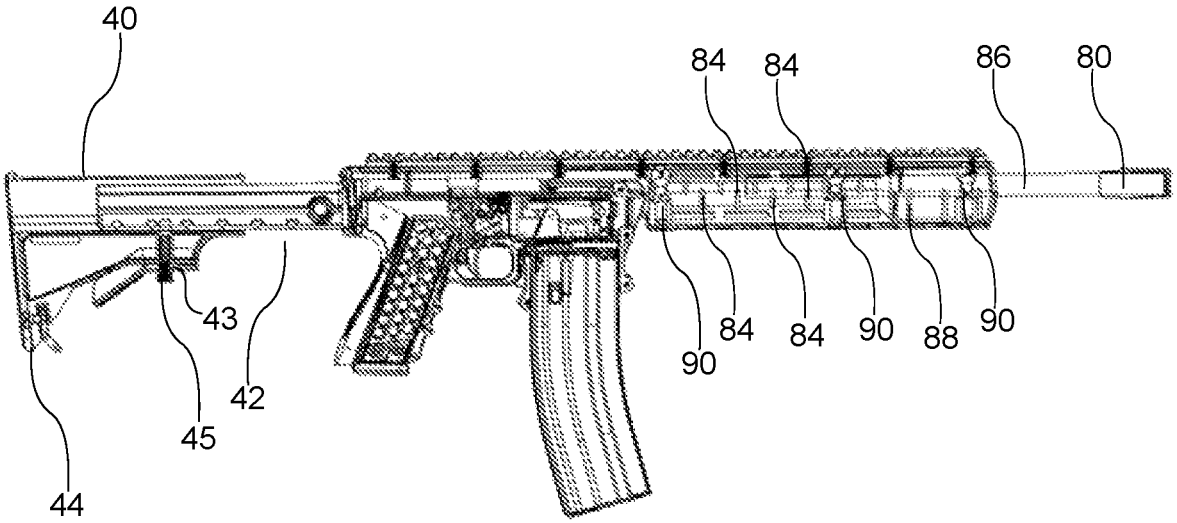
FIG. 13 is a partial sectional view taken along a line BB' of FIG. 12 showing the inert training pistol mounted into the rifle chassis and further an optional magazine which is an AR-15-style magazine in one form mounted therein to the rifle chassis, in accordance with an exemplary embodiment of the present disclosure.

Still discussing the forward end 24, attention will now be directed to the mock barrel 80. In general, firearms have a muzzle of some form. Although it is inherent that the rifle pistol training assembly to be identified as a training tool so as not to be confused as someone harnessing a live fire tool, it is found to be useful to have a mock barrel for various purposes. For example, when clearing a room, it is important not to "flag the muzzle" that is have the muzzle extend out to be laterally viewed before the operator enters the room. Therefore, having an extension such as a barrel provides valuable training insights for skills such as room clearing. Of course, it is further important to just match the general dimensions of a live fire rifle to understand how far the barrel sticks out to maneuver around objects, in particular, within vehicles where space is tightly confined. Further advantage of a mock barrel 80 is to simply add weight to the rifle pistol training assembly 20. When practicing target transitions of other maneuvers with the rifle, it's advantageous to have substantially similar weight to that of a live fire rifle so as to not over transition when coming on the target ad otherwise have a sense of feel and realism with the inertia when training. Therefore, a preferred form the mock barrel 80 is made from stainless steel rather than noncorrosive metal of higher density. Utilizing stainless steel stock is desirable because of its low cost, and of course, anticorrosive properties. One preferred form of mounting the mock barrel thereto the first and second frame members 70 and 72 is to have interior ribs grasp there around the mock barrel as shown in the partial sectional view FIG. 13. FIG. 13 shows a mock barrel 80 where rib section 84 of the first frame member 70 are provided and engage into corresponding rib sections in the second frame member 72. It should be noted that the mock barrel has a visible area 86 and a mount area 88. When the various fasteners generally denoted at 90 are loosened, the mount area 88 can reposition along the longitudinal area whereby effectively extending the visible area. This effectively turns the barrel length into a longer or shorter barrel. This is highly advantageous because some law enforcement agencies may short barrels and want to train with an AR15-like platform to exactly match the length of their barrel for room clearing around corners and doors and such. However, certain officers may run longer barrels such as 20 or even 24 inch barrels whereby it would desirous to extend the visible area by repositioning the mock barrel forward and then rigidly mounting it to the first and second frame members by tightening down the fasteners (generally nut and bolt assemblies 90 as shown in FIG. 13). Therefore, the system provides a very novel approach to adapt to different barrel lengths and also providing good hefty weight for realism.

Referring to the cross-sectional view of FIG. 13, it can be generally appreciated how the buttstock 40 is mounted to the buttstock mount 42. It can generally be appreciated that the lower extension 44 as a plurality of cylindrical openings 43 or rather surfaces defining cylindrical openings whereas configure to receive the pin 45 to adjust the length of the buttstock. Such a system is widely known in the arts but in a live fire tool cylindrical opening in the lower part of a substantially cylindrical buffer tube. Therefore, the non-cylindrical longitudinal extension 44 emulates such live fire took functionality.

It should finally be noted that the mock barrel has in one preferred form a cap 92. In a preferred form the cap 92 is simply a colored plastic injection cap of some form such as the color red, yellow, pink, or general colorization that does not generally indicate a live fire tool for purposes of safety. However, it should be noted that with the advent of coding systems, many live fire tools now have unique coloration not looking like a traditional "black" or gray firearm. At any rate, it is wise to have coloration to distinguish the training tool from a live fire tool.

As shown in, for example, FIG. 3 a cap 92 clearly does not provide for a center open hole. Therefore, when looking in the front portion of the gun for a forward vantage point such as that shown in FIG. 4 or better yet in FIG. 3, it is advantageous not to provide an actual muzzle hole in the front for another indication that the tool is that for training. In one form, plurality of smaller holes can be provided but not a conventional center colinear with the surrounding muzzle hole conventional with a live fire tool.

Figure 7:
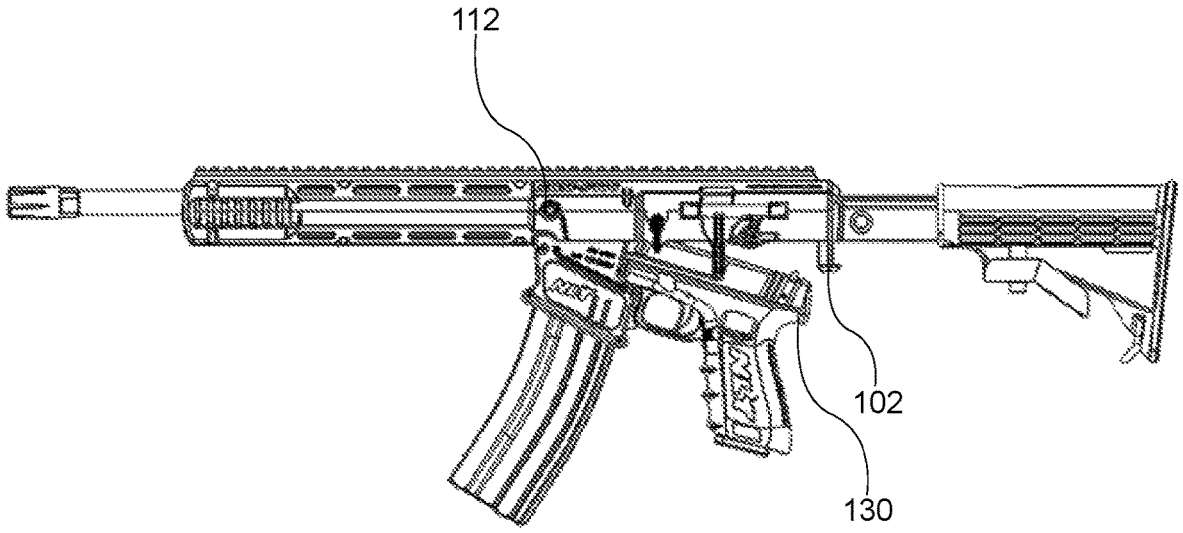
FIG. 7 shows a more close-up view than that of FIG. 6 where it can be appreciated that in one form of locking the inert training pistol to the rifle chassis a rearward lock member is utilized to engage the rearward upward tan portion of the pistol, in accordance with an exemplary embodiment of the present disclosure.

There will now be a discussion of the third and final aforementioned region of the rifle chassis 22 which is the center portion 26. The central portion 26, in general, is operably configured to have the inert training pistol 32 mount therein as for example shown in FIG. 5. There will now be some detailed discussions of a preferred form of undertaking this task and further providing a safety selector that is functional and extends the training value immensely for an end user. As shown in FIG. 5, there is a pistol mount region 30. The pistol mount region 30 is operably configured to have the inert training pistol 32 mount therein. Although the inert training pistol 32 is incorporated by reference of the aforementioned issued patent, a few notable areas for this discussion are the longitudinally forward region 96 which in a preferred form is the picatinny rail 98, as shown in FIG. 9. Although on a pistol, the picatinny rail system is not exactly to the specs of the picatinny, it is well known in the arts that there is a general overhang like section that allows for attachments to mount thereto. The term picatinny is somewhat generic even though it does relate to a specific protocol, but it can be appreciated there are lateral extending edges for mounts to either latch on the side and be clasped down or mount from an open front end and lock rearwardly such as a light to a pistol. But for this particular embodiment, the picatinny rail 98 is operably configured to mount to the pistol mount region and lock therein by way of the picatinny rail 98. Going now to FIG. 9, the picatinny rail receiving section 100 has a slight extension to fit into the lateral extending cavity 98*a* of the picatinny rail 98. As the pistol is mounted within the pistol mount region 30 as shown in FIG. 7, the pistol can then be in one form rotated upward and locked in by way of the rearward lock member 102 described further herein (and generally shown in a locked position in FIG. 9 with visual removal of the first frame member 70).

The pistol mount region 30 in one form is comprised from a pistol mount chassis 106 which in turn in one form is comprised of two separate components mainly, the left and right pistol mount chassis components noted 108 and 110 as shown in FIG. 1. Again, one preferred form of the manufacturer these are plastic injection parts and due to the internal complexities are molded as two separates substantially open and shut components and bolted there together to form a solid structure. In a preferred form, the pistol mount chassis 106 is rotationally mounted at position 112 (see FIGS. 1 and 4). This position 112 is referred to the pivot attachment location and in a preferred form is locked in place when attaching the first frame member 70 to the second frame member 72. Therefore, it can be generally appreciated that the first frame member 70 and second frame member 72 not only mount the mock barrel 80 to the rifle chassis 22 but to the and comprising the rifle chassis 22 but further are configured to pivotally attach the pivot mount chassis 106 thereto. Now referring to FIG. 9, it should first be noted that FIG. 9 is shown for ease of explanation with the complete removal of the first frame member (70 as shown in the other figures). Whereby FIG. 9 shows the rearward lock member 102 which is configured to be slidably mounted therein to the first frame member 70 (as for example shown in FIG. 7). The rearward lock member 102 is provided with the lock extension 120 whereby the lock extension 120 further provides a lock surface 122 as shown in FIG. 9. This lock surface 122 is biased in a longitudinal rearward direction to forcibly engage a locking surface shown in FIG. 1 at 124 which is a portion of the first frame member 70. Therefore, it can be appreciated that when the rearward lock member 102 is positioned in a vertical manner whereby engaging the rearward upper hang portion 130 of the inert training pistol 32, the pistol is therein internally locked to the rifle chassis 22 whereby the lock extension 170 is biased longitudinally rearwardly so the lock surface 122 sits right there above the locking surface 124 (FIG. 1).

Figure 6:
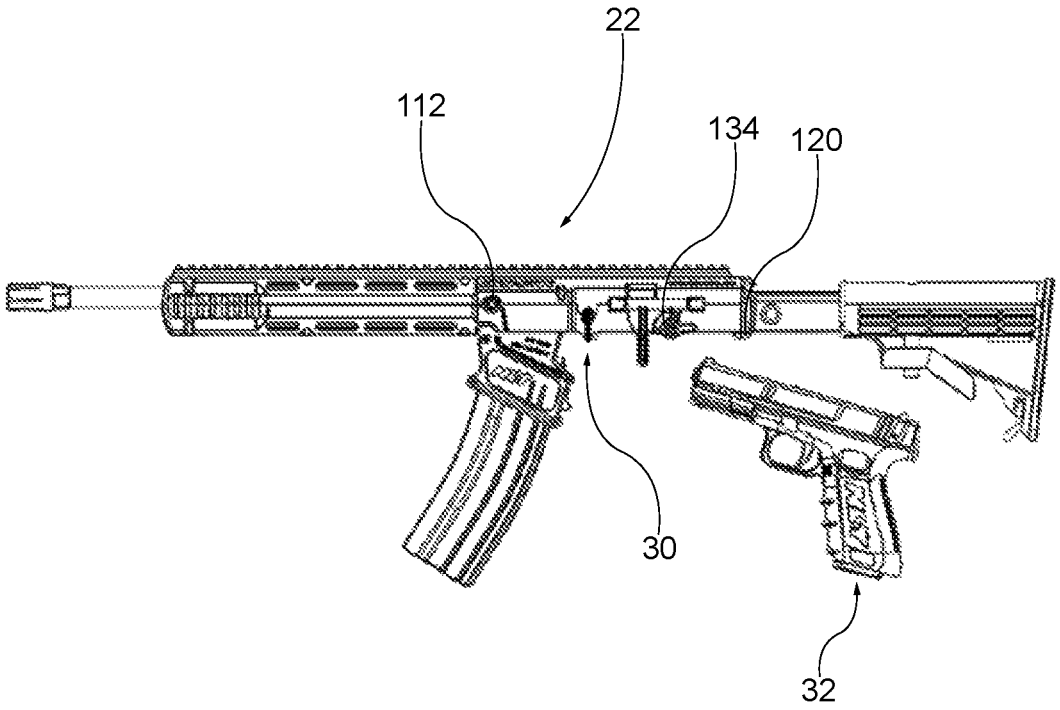
FIG. 6 shows the inert training pistol mounted therein to the pistol mount region of the rifle chassis but not fully locked thereto the rifle chassis, in accordance with an exemplary embodiment of the present disclosure.

To remove the pistol from the rifle chassis 22, the disengagement surface 134 is pressed longitudinally forwardly thereby disengaging the lock surface 122 from (see FIG. 9) from the locking surface 124 of the first frame member 70 (now referred to FIG. 1) whereby allowing the rearward lock member 102 to reposition downwardly along with the inert training pistol 32. Then at this point the pistol would be in orientation as shown in FIG. 6 and could be simply withdrawn rearwardly and pulled away from the rifle chassis 22 as that is shown in FIG. 5.

Therefore, it can be appreciated that in the preferred embodiment there is a slick method of getting the pistol in and out of the rifle chassis to change from pistol training to rifle training in an extraordinarily efficient and quick manner. It should be further noted that the locking system is particularly efficient and rigidly mounting the pistol, the inert training pistol 32 whereby the mini lasers are operably configured to extend out the surface defining the front port 140 to have a shot indicating laser effect. Therefore, it can be appreciated as shown in FIG. 3, no laser is emitted from the mock barrel 80 but rather, shot indicating and trigger prep indicating lasers from the inert training pistol 32 are provided to as they're under the mock barrel 80 through the surface defining the opening 140. This allows for, of course, very inexpensive rifle chassis 22 to be manufactured for the intent logical heavy lifting is done in the inert training pistol 32.

Figure 4:
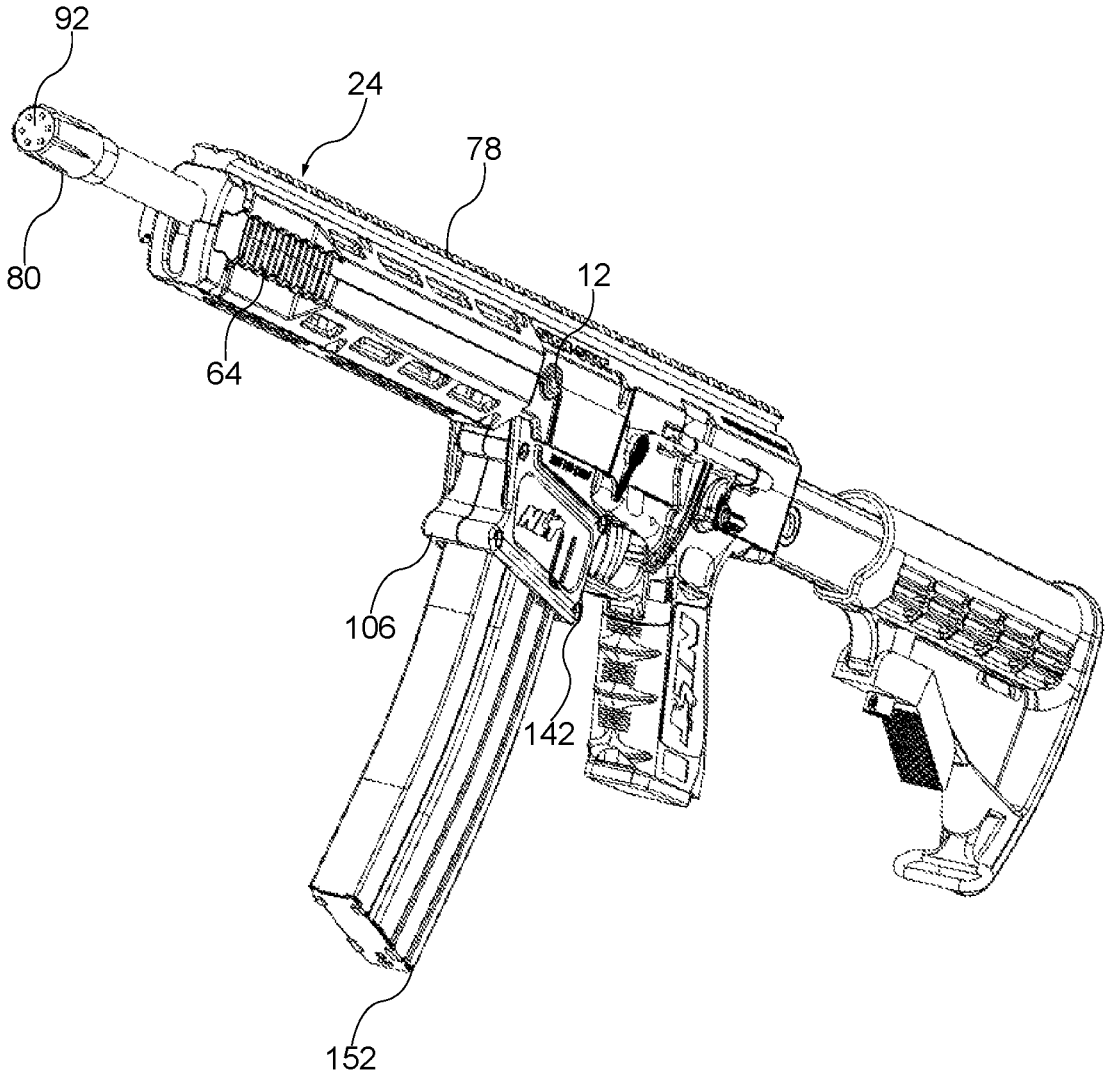
FIG. 4 shows an isometric view of the rifle pistol training assembly from an upward and longitudinally forward vantage point, in accordance with an exemplary embodiment of the present disclosure.

It should be further noted that the rifle mount chassis 106 is configured to have an interior cavity to mount a magazine therein. For example, as shown in FIG. 4, the first surface defining mag receiving cavity 142 is the interior surface and now referring to the left vantage point in FIG. 1, the left pistol chassis mount component 108 is provided with a mag engaging extension 150 that is operably configured to extend into a mag catch indentation within the magazine 152. The magazine 152 (along with the buttstock 40 are not part of the main rifle chassis 22 but extensions thereto). In other words, these items are generally aftermarket items fitted to the rifle chassis 22 for further training effect and authenticity. It should be noted that the surface defining the mag recess cavity 142 is approximate to that of a live fire tool but not exactly like an AR15 as whereby in one form there is not a mag release but rather, as shown in FIG. 1, the mag engagement extension 150 will slightly lock the magazine 152 therein but allow for the magazine 152 to be manually and forcibly withdrawn therefrom the rifle chassis 22.

With the foregoing submit matter in place, the final main component to describe in detail is the selector switch 160. Referring to FIG. 9, it can be appreciated that the selector switch 160 generally has attributes similar to many live fire rifles. In particular, the preferred embodiment shows the selector switch 160 to emulate the functional features of a conventional AR15 platform. As noted in the background, use of the selector switch is absolutely critical for safe modern handing of an AR-15. Therefore, it is of great benefit to end users to train the selector switch (otherwise known as the safety) to become second nature when shooting a rifle.

Figure 8:
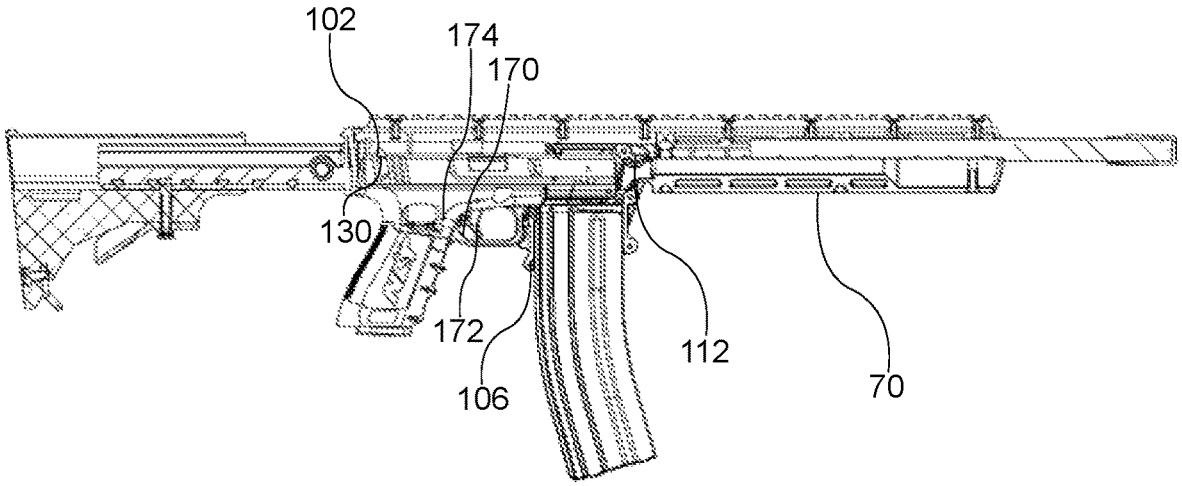
FIG. 8 shows a partial sectional view of the rifle chassis whereby showing in greater detail the selector switch and mainly how the lateral extension of the safety bar is interposed in between the trigger and the frame of the pistol, in accordance with an exemplary embodiment of the present disclosure.
Figure 14:
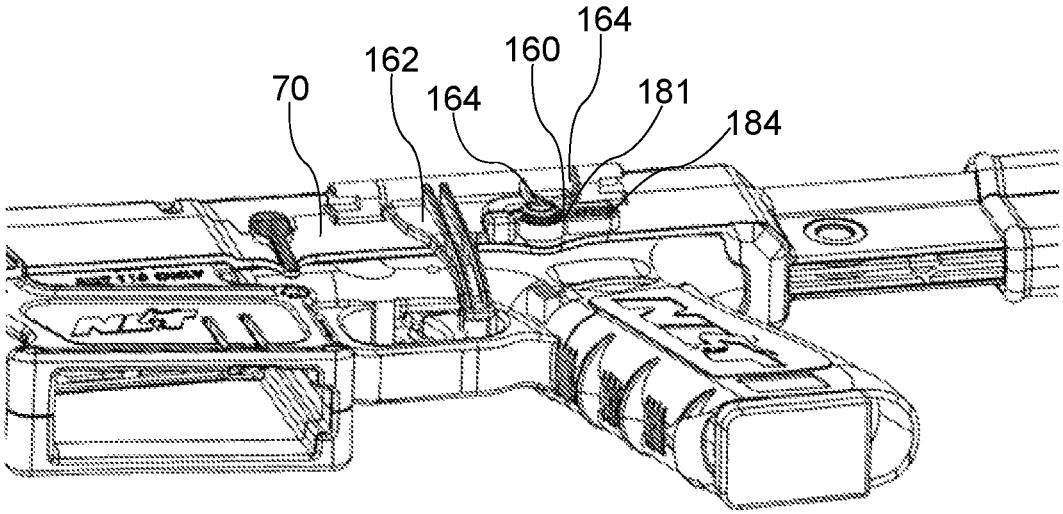
FIG. 14 illustrates a closer view of a portion of the rifle chassis depicting a selector switch to be shown from a perspective downward side, in accordance with an exemplary embodiment of the present disclosure.
Figure 15:
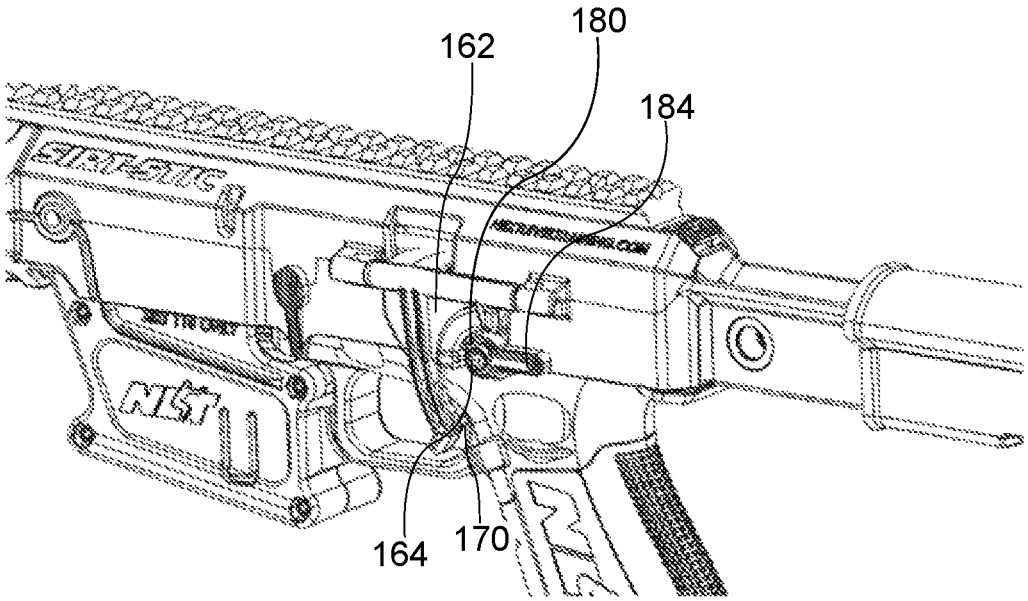
FIGS. 15 and 16 illustrate closer views of a portion of the rifle chassis depicting a selector switch to be shown from perspective diagonal sides, in accordance with an exemplary embodiment of the present disclosure.
Figure 16:
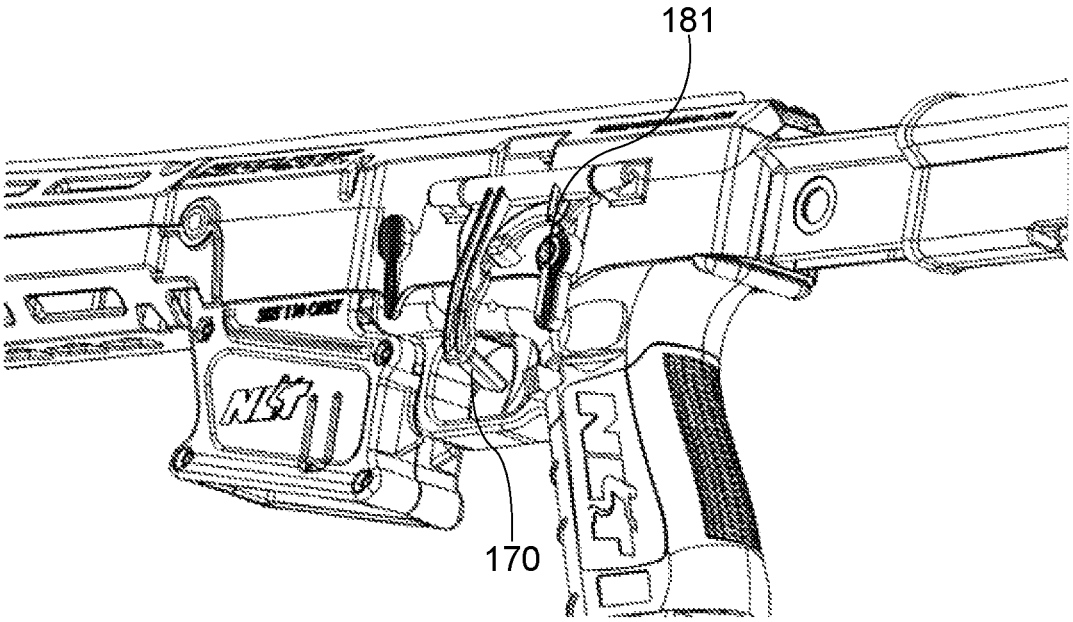
Figure 17:
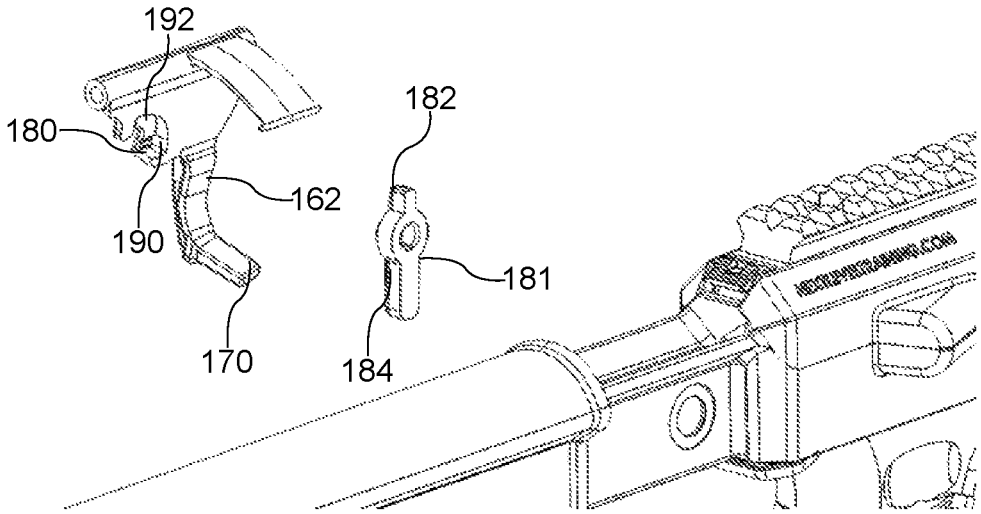
FIG. 17 illustrates a closer and exploded view of a portion of the rifle chassis depicting a selector switch, in accordance with an exemplary embodiment of the present disclosure.

As shown in FIG. 9 and also shown in close-up view of FIGS. 14 to 16 and exploded view of FIG. 17, the selector switch 160 is generally comprised of a safety bar 162. The safety bar 162 is pivotally mounted at a Pivot Base 164 to either weld to the first frame member 70. It should be noted at this time the first frame member 70 and second frame member 72 are configured in a desirable orientation to mount other components to the rifle chassis, but of course, these frame members can be formed in a variety of ways and components to not depart from the spirit and scope of the claimed invention. The one form the pivot base 164 is pivotally mounted to the first frame member 70 which is shown in FIG. 14 whereby only one of the mount locations noted at 166 is shown, but it can be appreciated that the second mount location such as that is shown at 168 in FIG. 1 is provided to firmly lock the pivot base 164 therein. In the lower portion of the safety bar 162 is the lateral extension 170. The lateral extension 170 provides a key role in rendering the inert training pistol 32 the ability to fire or not by simply interposing the lateral extension between the trigger 172 and the frame 174 (FIG. 8). In other words, the very simple mechanical placement of the lateral extension can make the Trigger 172 inoperable and not able to pull rearward. This provides tremendous feedback for the end user who tries to pull the trigger with the safety on (that is the thumb engagement portion in a substantially longitudinal aligned orientation) and reaffirm that the safety is on and the trigger cannot be pulled. Generally speaking, in AR15 rifle craft where the gun comes up, the thumb extension portion goes down, when the gun goes down, the thumb extension portion comes up to the safe position. All AR15's operate in this manner (although it should be noted there are left and right safety selectors and some of them of course do have full auto switches to extend the thumb extension portion forward). In training, this is a critical skill for end users.

Further shown in FIGS. 14 to 17, the safety bar 162 has a laterally slanted surface 180 (clearly seen in FIGS. 15 and 17). The laterally slanted surface 180 includes the laterally interior surface of the safety bar 162 is operably configured to engage the biasing surface 182 of the Safety Selector 181. In general, the safety selector 181 not only has a biasing surface 182 but further has a very conventional thumb extension portion 184 which is configured to be rotated presumably with the end user's thumb, but on occasion, with the index finger of an end user. However, the laterally slanted surface 180 has two main regions, the first is a laterally outward portion 190 which is formed the lower portion and is generally laterally outward with respect to the laterally inward portion 192 which in this form is the upper portion of the safety bar 162, as seen in FIG. 17. It can therefore be appreciated that when the safety selector 181 is rotated in a clockwise position at 90 degrees, the biasing surface 182 of the safety selector 181 will press there against the laterally slanted surface 180 and slide up to the laterally inward portion 192 whereby bringing the Lateral Extension 170 laterally outward and no longer interposed between the trigger and the frame. In other words, the safety system works incredibly well to emulate a completely different mechanism of an AR15 for its safety to not allow the trigger to be depressed but rather allow for a training system to have the same end functionality but of course work between a rifle retro fitted to an inert pistol. It can be appreciated that this mechanism related to the safety can be carried out in a variety of fashions. As a very simple alteration, the laterally extended surface can be of different rotational orientations so, for example, the biasing surface 182 may not be at the opposing region from the thumb engagement portion 184 but rather could be ratably repositioned there around along with a repositioning of the laterally slanted surface. Further, other forms of linkages and pivot mechanisms can be used to, for example, rotate the safety from the position as shown in FIG. 9 to a more vertical orientation of the thumb engagement portion 184 whereby pulling or pushing the member inward or outward to engage some form of a laterally slanted surface to bias where the effectively lateral extension 170 from behind the trigger rendering it operable. In other words, the mechanism can be carried out in a variety of forms, but a preferred form which is a manufacturer is the form that's shown in FIG. 9 and in FIGS. 14 to 17.

Figure 18:
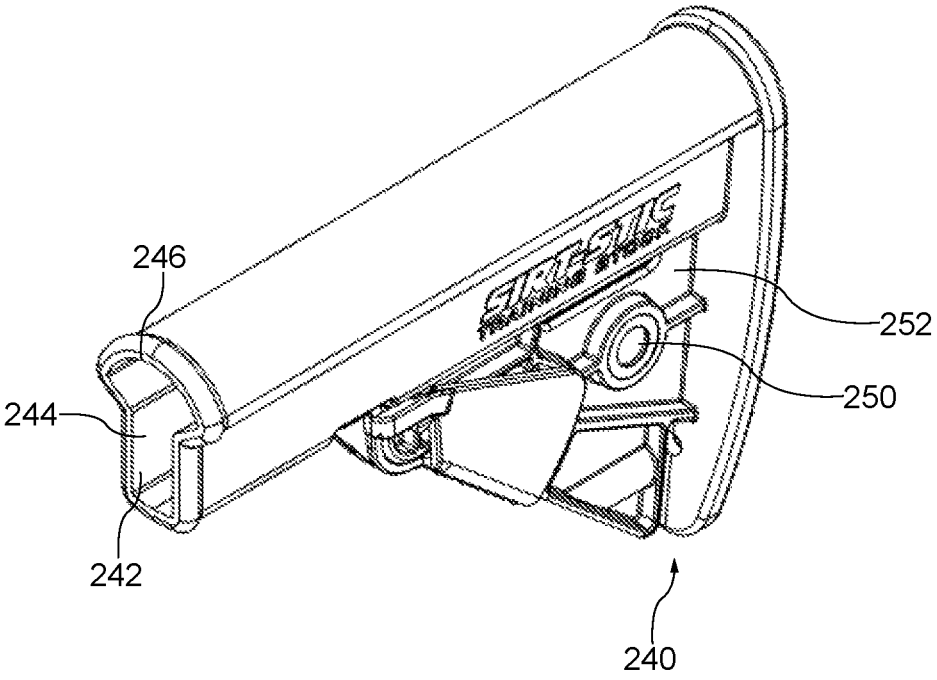
FIG. 18 illustrates a preceptive front view of a dedicated training buttstock for a rifle pistol training assembly, in accordance with an exemplary embodiment of the present disclosure.
Figure 19:
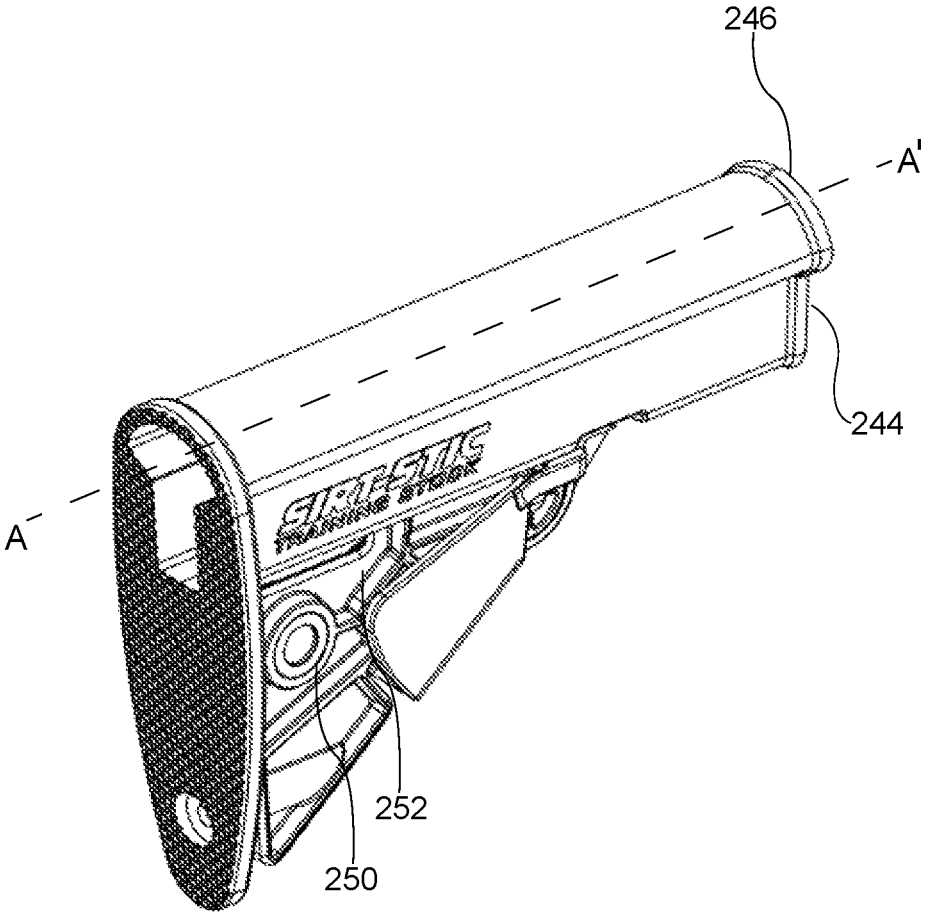
FIG. 19 illustrates a preceptive back view of the dedicated training buttstock of FIG. 18, in accordance with an exemplary embodiment of the present disclosure.
Figure 20:
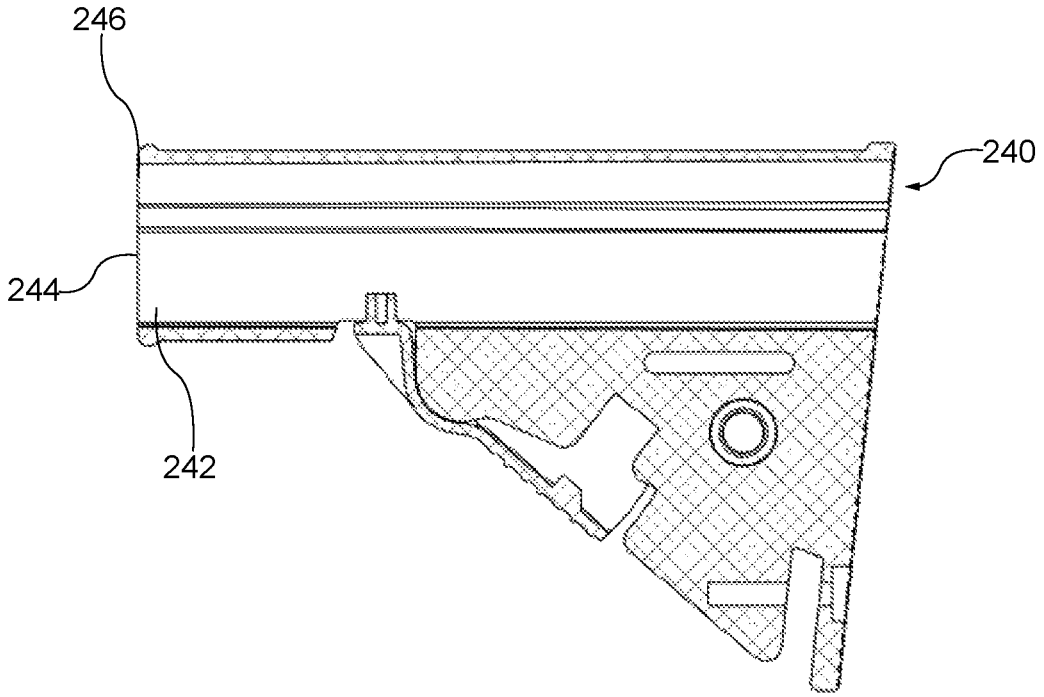
FIG. 20 illustrates a sectional view of the dedicated training buttstock along line A-A' of FIG. 19, in accordance with an exemplary embodiment of the present disclosure.

Referring now to FIGS. 18 to 20, there is another embodiment of the buttstock, such as a dedicated training buttstock 240, in addition to the buttstock 40 as shown and described in reference to above FIGS. 1-17. In one form, the training buttstock 240 includes an interior surface 242 that may be non-cylindrical but rather somewhat mushroom shaped having a base area 244 and an upper semi cylindrical surface 246 (in one form). Such non cylindrical surface allows for the training buttstock 240 to be dedicated and fit only to the training rifle but not be able to fit on a live fire rifle such as an AR15. As further shown in FIG. 18, a sling mount 250 may be provided which in one form is in aluminum over molded component in a plastic injection bass 252. The sling mount 250 may be of a design such as the quick detach mount specifications which generally provides a small lip for a sling ball detent to pass thereby and lock thereto.

The present disclosure is advantageous in having the cost-effective assembly of a pistol-rifle combination is extraordinarily beneficial for an end user or an instructor to fluidly allow rifle and pistol training in a single class. By having a chassis system operably configured to SIRT or other inert tool knotted therein is extraordinarily advantageous to repurpose all the intimate details and technology of a laser emitting device with a robust auto resetting trigger into a rifle chassis. The rifle chassis can be produced and sold relatively economically whereby a lot of the technological heavy lifting is done by the pistol.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present disclosure.

What is claimed is:

1. A rifle pistol training assembly operatively configured to allow a user to train with either a rifle or a pistol with inert firearm training tools, the assembly comprising:

a. a rifle chassis comprising a forward end, a central portion, and a buttstock region, b. a pistol mount region generally located at the central portion of the rifle chassis, c. an inert training pistol configured to have a trigger movably mounted thereto, wherein said trigger is configured to have a forward position and a rearward position being configured to be repositioned from a forward position to a rearward position by the user, d. wherein the rifle pistol training assembly being operatively configured to allow the user to train with the inert training pistol or mount the inert training pistol to the pistol mount region of the rifle chassis, whereby providing for rifle training, and whereby the trigger of the training pistol now emulates a trigger for a rifle for training therewith by the user; and e. a selector switch having a safety selector, wherein the safety selector is pivotally mounted to the rifle chassis, and wherein the safety selector is operatively configured to bias a safety bar having a lateral extension that is configured to be interposed between the trigger of the inert training pistol and a frame of the inert training pistol.

2. The rifle pistol training assembly as recited in claim 1, wherein the buttstock region comprises a buttstock.

3. The rifle pistol training assembly as recited in claim 2, wherein the butt-stock is movable along a longitudinal axis to various positions, therein, the buttstock region of the rifle chassis.

4. The rifle pistol training assembly as recited in claim 2, wherein the buttstock region has a non-circular dimension, whereby not provided for a spring or other biasing device to be mounted therein.

5. The rifle pistol training assembly as recited in claim 1, wherein the inert training pistol is provided with a picatinny rail in a longitudinally forward region of the inert training pistol, and said picatinny rail is operatively configured to mount to a picatinny rail receiving surface of the pistol mount region of the rifle chassis.

6. The rifle pistol training assembly as recited in claim 1, wherein the pistol mount region comprises:

a mount member that is pivotally attached to a rifle base and wherein, at a longitudinally rearward location to a pivot attachment location, a rearward lock member is provided having a lock extension that defines a lock surface, which is operatively configured to engage a locking surface of the rifle base.

7. The rifle pistol training assembly as recited in the claim 1, wherein the safety bar is connected to a pivot base where said safety selector is provided with a biasing surface, and said biasing surface of safety selector is operatively configured to reposition the pivot base laterally outward, wherein the lateral extension moves from a safety-on position where the lateral extension is interposed between the trigger and the frame and the safety selector is configured to position the biasing surface wherein a portion of the pivot base moves laterally outward, so the lateral extension of the safety bar is not interposed between the trigger and the frame of the inert training pistol, wherein allowing the trigger to freely travel from the forward position to the rearward position.

8. The rifle pistol training assembly as recited in claim 7, wherein the pivot base is pivotally connected to the rifle chassis and further has a laterally inward-extending member that is configured to engage a top portion of the inert training pistol so as when the inert training pistol is mounted to the rifle chassis, the laterally inward-extending member repositions vertically upwardly, wherein biasing the lateral extension of the safety bar laterally inwardly.

9. The rifle pistol training assembly as recited in claim 7, wherein the safety selector having the biasing surface is operatively configured to engage a laterally-slanted surface of the safety bar, wherein when the safety selector has a thumb engagement portion extended substantially in a longitudinal direction, the biasing surface of the safety selector is engaging a laterally outward portion of the laterally-slanted surface, wherein allowing the lateral extension to extend laterally inward to be interposed between the trigger and the frame of the inert training pistol, wherein when the safety selector thumb engagement potion is repositioned in a substantially vertical orientation, the biasing surface is now engaging a laterally inward portion of the laterally-slanted surface, which wherein biases the lateral extension of the safety bar laterally outward so as not to be interposed between the trigger and the frame, allowing free motion of the trigger and the frame from the set forward to rearward positions.

10. The rifle pistol training assembly as recited in claim 9, wherein the mount member has a surface defining a mag-receiving cavity to allow a magazine to be mounted therein.

11. The rifle pistol training assembly as recited in claim 10, wherein the surface defining a mag-receiving cavity is operatively configured to receive a conventional AR15 magazine, wherein the rifle chassis has a picatinny rail mounted in the upper portion.

12. The rifle pistol training assembly as recited in claim 1, wherein the buttstock region has a sling mount fixedly attached thereto.

13. The rifle pistol training assembly as recited in claim 12, wherein the sling mount is a metallic component overmolded within a plastic injection buttstock region.

14. The rifle pistol training assembly as recited in claim 1, wherein the rifle chassis is comprised of first and second frame members, wherein a mock barrel is interposed to the first and second frame members.

15. The rifle pistol training assembly as recited in claim 14, wherein the mock barrel is comprised of stainless streel and could be repositioned in the longitudinal direction.

16. The rifle pistol training assembly as recited in claim 1, wherein the rifle chassis comprises a forward grip region having a picatinny rail and surfaces defining mounting points.

17. The rifle pistol training assembly as recited in claim 16, wherein the inert training pistol is configured to mount within the picatinny rail receiving service and rotate upward, wherein the rearward lock member is operatively configured to house a rearward upper tang portion of the inert training pistol and a lock extension, having a locking surface, snaps to a locking surface of the rifle chassis.

18. The rifle pistol training assembly as recited in claim 17, wherein the lock extension has a disengagement surface, wherein end user pressing the disengagement surface will release interaction between the locking surface of the lock extension and the locking surface of the rifle chassis, wherein allowing the rearward lock member to reposition substantially downwardly with the inert training pistol, so thereby, the inert training pistol can be removed and separated from the rifle chassis.

* * * * *